US006394749B2

(12) United States Patent
Yu et al.

(10) Patent No.: US 6,394,749 B2
(45) Date of Patent: May 28, 2002

(54) APPARATUS AND METHODS FOR RELIEVING THERMALLY INDUCED STRESSES IN INNER AND OUTER BANDS OF THERMALLY COOLED TURBINE NOZZLE STAGES

(75) Inventors: Yufeng Phillip Yu, Guilderland; Gary Michael Itzel, Clifton Park, both of NY (US); Victor H. S. Correia, Milton Mills, NH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/761,635

(22) Filed: Jan. 18, 2001

Related U.S. Application Data

(63) Continuation of application No. 09/311,640, filed on May 14, 1999, now abandoned.

(51) Int. Cl.[7] ..... F01D 9/06

(52) U.S. Cl. ..... 415/115; 415/116; 415/117; 415/176; 415/178

(58) Field of Search ..... 415/115, 116, 415/117, 175, 176, 177, 178; 416/95, 96 R, 97 R

(56) References Cited

U.S. PATENT DOCUMENTS

| | | | | |
|---|---|---|---|---|
| 3,975,901 A | * | 8/1976 | Hallinger et al. | 415/115 |
| 4,126,405 A | * | 11/1978 | Bobo et al. | 415/115 |
| 5,098,257 A | * | 3/1992 | Hultgren et al. | 415/115 |
| 5,538,393 A | * | 7/1996 | Thompson et al. | 415/115 |

OTHER PUBLICATIONS

"39$^{th}$ GE Turbine State–of–the–Art Technology Seminar", Tab 1, ""F" Technology–the First Half–Million Operating Hours", H.E. Miller, Aug. 1996.

"39$^{th}$ GE Turbine State–of–the–Art Technology Seminar", Tab 2, "GE Heavy–Duty Gas Turbine Performance Characteristics", F.J. Brooks, Aug. 1996.

"39$^{th}$ GE Turbine State–of–the–Art Technology Seminar", Tab 3, "9EC 50Hz 170–MW Class Gas Turbine", A.S. Arrao, Aug. 1996.

"39$^{th}$ GE Turbine State–of–the–Art Technology Seminar", Tab 4, "MWS6001FA–An Advanced–Technology 70–MW Class 50/60 Hz Gas Turbine", Ramachandran et al., Aug. 1996.

"39$^{th}$ GE Turbine State–of–the–Art Technology Seminar", Tab 5, "Turbomachinery Technology Advances at Nuovo Pignone", Benvenuti et al., Aug. 1996.

"39$^{th}$ GE Turbine State–of–the–Art Technology Seminar", Tab 6, "Aeroderivative Gas Turbines–Design and Operating Features", M.W. Horner, Aug. 1996.

"39$^{th}$ GE Turbine State–of–the–Art Technology Seminar", Tab 7, "Advance Gas Turbine Materials and Coatings", P.W. Schilke, Aug. 1996.

"39$^{th}$ GE Turbine State–of–the–Art Technology Seminar", Tab 8, "Dry Low $NO_x$ Combustion Systems for GE Heavy–Duty Turbines", L.B. Davis, Aug. 1996.

(List continued on next page.)

*Primary Examiner*—Christopher Verdier
(74) *Attorney, Agent, or Firm*—Nixon & Vanderhye

(57) ABSTRACT

To control the temperature mismatch between the inner and outer bands and covers forming plenums with the inner and outer bands on sides thereof remote from the hot gas path, passages extend from the leading edge of the covers in communication with the hot gases of combustion to the trailing edge of the covers in communication with the hot gas flowpath. A mixing chamber is provided in each passage in communication with compressor discharge air for mixing the hot gases of combustion and compressor discharge air for flow through the passage, thereby heating the cover and minimizing the temperature differential between the inner and outer bands and their respective covers. The passages are particularly useful adjacent the welded or brazed joints between the covers and inner band portions.

20 Claims, 4 Drawing Sheets

OTHER PUBLICATIONS

"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D.M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines, " J.R. Johnston, Aug. 1996.
"39th GE Turbine State–of–the–Art Technology Seminar", Tab 16, "Gas Turbine Repair Technology", Crimi et al., Aug. 1996.
"39th GE Turbine State–of–the–Art Technology Seminar", Tab 17, "Heavy Duty Turbine Operating & Maintenance Considerations", R.F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D.R. Leger, Aug. 1996.
"39th GE Turbine State–of–the–Art Technology Seminar", Tab 25, "Steam Turbines for STAGm Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–DensityTM Steam Turbine Design Evolution", J.H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D.R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology", J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program–Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2–Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Numbers DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996. H. Technology Tests/ppg. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency", Press Information, Press Release, Power–Gen Europe '95, 95–NRR15, Advanced Technology Introduction/pp. 1–6.

"Gas, Steam Turbine Work as Single Unit in GE's Advanced H Technology Combined–Cycle System", Press Information, Press Release, 95–NR18, May 16, 1995. Advanced Technology Introduction/pp. 1–3.

"GE Breaks 60% Net Efficiency Barrier" paper, p. 4.

"GE Businesses Share Technologies and Experts to Develop State–of–The–Art Products", Press Information, Press Release 95–NR10, May 16, 1995, GE Technology Transfer/pp. 1–3.

"General Electric ATS Program Technical Review, Phase 2 Activities", T. Chance et al., pp. 1–4.

"General Electric's DOE/ATS H Gas Turbine Development" Advanced Turbine Systems Annual Review Meeting, Nov. 7–8, 1996, Washington, D.C. Publication Release.

"H Technology Commercialization", 1998 MarComm Activity Recommendation, Mar. 1998.

"H Technology", Jon Ebacher, VP, Power Gen Technology, May 8, 1998.

"H Testing Process", Job Ebacher, VP, Power Gen Technology, May 8, 1998.

"Heavy–Duty & Aeroderivative Products" Gas Turbines, Brochure, 1998.

"MS7001H/MS9001H Gas Turbine, gepower.com website for PowerGen Europe" Jun. 1–3 going public June 15, (1995).

"New Steam Cooling System is a Key to 60% Efficiency For GE "H" Technology Combined–Cycle Systems", Press Information, Press Release, 95–NRR16, May 16, 1995, H Technology/pp. 1–3.

"Overview of GE's H Gas Turbine Combined Cycle", Jul. 1, 1995 to Dec. 31, 1997.

"Power Systems for the 21st Century–"H"Gas Turbine Combined Cycles", Thomas C. Paul et al., Report.

"Power–Gen '96 Europe", Conference Programme, Budapest, Hungary, Jun. 26–28, 1996.

"Power–Gen International", 1998 Show Guide, Dec. 9–11, 1998, Orange County Convention Center, Orlando, Florida.

"Press Coverage following 1995 product announcement"; various newspaper clippings relating to improved generator.

"Proceedings of the Advanced Turbine Systems Annual Program Review Meeting", vol. I, "Industrial Advanced Turbine Systems Program Overview", D.W. Esbeck, pp. 3–13, Oct. 1995.

"Proceedings of the Advanced Turbine Systems Annual Program Review Meeting", vol. I, "H Gas Turbine Combined Cycle", J. Corman, pp. 14–21, Oct. 1995.

"Proceedings of the Advanced Turbine Systems Annual Program Review Meeting", vol. I, "Overview of Westinghouse's Advanced Turbine Systems Program", Bannister et al., pp. 22–30, Oct. 1995.

"Proceedings of the Advanced Turbine Systems Annual Program Review Meeting", vol. I, "Allison Engine ATS Program Technical Review", D. Mukavetz, pp. 31–42, Oct. 1995.

"Proceedings of the Advanced Turbine Systems Annual Program Review Meeting", vol. I, "Advanced Turbine Systems Program Industrial System Concept Development", S. Gates, pp. 43–63, Oct. 1995.

"Proceedings of the Advanced Turbine Systems Annual Program Review Meeting", vol. I, "Advanced Turbine System Program Phase 2 Cycle Selection", Latcovich, Jr., pp–64–69, Oct. 1995.

"Proceedings of the Advanced Turbine Systems Annual Program Review Meeting", vol. I, "General Electric ATS Program Technical Review Phase 2 Activities", Chance et al., pp. 70–74, Oct. 1995.

"Proceedings of the Advanced Turbine Systems Annual Program Review Meeting", vol. I, "Technical Review of Westinghouse's Advanced Turbine Systems Program", Diakunchak et al., pp. 75–86, Oct. 1995.

"Proceedings of the Advanced Turbine Systems Annual Program Review Meeting", vol. I, "Advanced Combustion Turbines and Cycles: An EPRI Perspective", Touchton et al., pp. 87–88, Oct. 1995.

"Proceedings of the Advanced Turbine Systems Annual Program Review Meeting", vol. I, "Advanced Turbine Systems Annual Program Review", William E. Koop, pp. 89–92, Oct. 1995.*

"Proceedings of the Advanced Turbine Systems Annual Program Review Meeting", vol. I, "The AGTSR Consortium: An Update", Fant et al., pp. 93–102, Oct. 1995.*

"Proceedings of the Advanced Turbine Systems Annual Program Review Meeting", vol. I "Overview of Allison/AGTSR Interactions", Sy A. Ali, pp. 103–106, Oct. 1995.*

"Proceedings of the Advanced Turbine Systems Annual Program Review Meeting", vol. i, "Design Factors for Stable Lean Premix Combustion", Richards et al., pp. 107–113, Oct. 1995.*

"Proceedings of the Advanced Turbine Systems Annual Program Review Meeting", vol. I, "Ceramic Stationary as Turbine", M. van Roode, pp. 114–147, Oct. 1995.*

"Proceedings of the Advanced Turbine Systems Annual Program Review Meeting", vol. I, "DOE/Allison Ceramic Vane Effort", Wenglarz et al., pp. 148–151, Oct. 1995.*

"Proceedings of the Advanced Turbine Systems Annual Program Review Meeting", vol. I, "Materials/Manufacturing Element of the Advanced Turbine Systems Program", Karnitz et al., pp. 152–160, Oct. 1995.*

"Proceedings of the Advanced Turbine Systems Annual Program Review Meeting", vol. I "Land–Based Turbine Casting Initiative", Mueller et al., pp. 161–170, Oct. 1995.*

"Proceedings of the Advanced Turbine Systems Annual Program Review Meeting", vol. I "Turbine Airfoil Manufacturing Technology", Kortovich, pp. 171–181, Oct. 1995.*

"Proceedings of the Advanced Turbine Systems Annual Program Review Meeting", vol. I, "Pratt & Whitney Thermal Barrier Coatings", Bornstein et al., pp. 182–193, Oct. 1995.*

"Proceedings of the Advanced Turbine Systems Annual Program Review Meeting", vol. I, "Westinhouse Thermal Barrier Coatings", Goedjen et al., pp. 194–199, Oct. 1995.*

"Proceedings of the Advanced Turbine Systems Annual Program Review Meeting", vol. I, "High Performance Steam Development", Duffy et al., pp. 200–220, Oct. 1995.*

"Proceedings of the Advanced Turbine Systems Annual Program Review Meeting", vol. II, "Lean Premixed Combustion Stabilized by Radiation Feedback and heterogeneous Catalysis", Dibble et al., pp. 221–232, Oct. 1995.*

"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct. 1995.*

"Proceedings of the Advanced Turbine Systems Annual Program Review Meeting", vol. II, "Lean Premixed Flames for Low $No_x$ Combustors", Sojka et al., pp. 249–275, Oct. 1995.*

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct. 1995.*

"Proceedings of the Advanced Turbine Systems Annual Program Review Meeting", vol. II, "Advanced Turbine Cooling, Heat Transfer, and Aerodynamic Studies", Han et al., pp. 281–309, Oct. 1995.*

"Proceedings of the Advanced Turbine Systems Annual Program Review Meeting", vol. II, "Life Prediction of Advanced Materials for Gas Turbine Application", Zamrik et al., pp. 310–327, Oct. 1995.*

"Proceedings of the advanced Turbine Systems Annual Program Review Meeting", vol. II, "Advanced Combustion Technologies for Gas Turbine Power Plants", Vandsburger et al., pp. 328–352, Oct. 1995.*

"Proceedings of the Advanced Turbine Systems Annual Program Review Meeting", vol. II, "Combustion Modeling in Advanced Gas Turbine Systems", Smoot et al., pp. 353–370, Oct. 1995.*

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct. 1995.*

"Proceedings of the Advanced Turbine Systems Annual Program Review Meeting", vol. II "Rotational Effects on Turbine Blade Cooling", Govatzidakia et al., pp. 391–292, Oct. 1995.*

"Proceedings of the Advanced Turbine Systems Annual Program Review Meeting", vol. II, "Manifold Methods for Methane Combustion", Yang et al., pp. 393–409, Oct. 1995.

"Proceedings of the Advanced Turbine Systems Annual Program Review Meeting", vol. II "Advanced Multistage Turbine Blade Aerodynamics, Performance, Cooling, and Heat Transfer", Fleeter et al., pp. 410–414, Oct. 1995.

"Proceedings of the Advanced Turbine Systems Annual Program Review Meeting, vol. II", "The Role of Reactant Unmixedness, Strain Rate, and Length Scale on Premixed Combustor Performance, Samuelsen et al., pp. 415–422, Oct. 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct. 1995.

"Proceedings of the Advanced Turbine Systems Annual Program Review Meeting", vol. II, "Compatibility of Gas Turbine Materials with Steam Cooling", Desai et al., pp. 452–464, Oct. 1995.

"Proceedings of the Advanced Turbine Systems Annual Program Review Meeting", vol. II, "Use of a Laser–Induced Fluorescence Thermal Imaging System for Film Cooling Heat Transfer Measurement", M.K. Chyu, pp. 465–473, Oct. 1995.

"Proceedings of the Advanced Turbine Systems Annual Program Review Meeting", vol. II, "Effects of Geometry on Slot–Jet Film Cooling Performance, Hyams et al., pp. 474–496 Oct. 1995.

"Proceedings of the Advanced Turbine Systems Annual Program Review Meeting", vol. II, "Steam as Turbine Blade Coolant: Experimental Data Generation", Wilmsen et al., pp. 497–505, Oct. 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct. 1995.

"Proceedings of the Advanced Turbine Systems Annual Program Review Meeting", vol. II, "Premixed Burner Experiments: Geometry, Mixing, and Flame Structure issues", Gupta et al., pp. 516–528, Oct. 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct. 1995.

"Proceedings of the Advanced Turbine Systems Annual Program Review Meeting", vol. II, "Bond Strength and Stress Measurements in Thermal Barrier Coatings", Gell et al., pp. 539–549, Oct. 1995.

"Proceedings of the Advanced Turbine Systems Annual Program Review Meeting", vol. II, "Active Control of Combustion Instabilities in Low $NO_x$ Gas Turbines", Zinn et al., pp. 550–551, Oct. 1995.

"Proceedings of the Advanced Turbine Systems Annual Program Review Meeting", vol. II, "Combustion Instability Modeling and Analysis", Santoro et al., pp. 552–559, Oct. 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct. 1995.

"Proceedings of the Advanced Turbine Systems Annual Program Review Meeting", vol. II, "Heat Pipe Turbine Vane Cooling", Langston et al., pp. 566–572, Oct. 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct. 1995.

"Proceedings of the Advanced Turbine Systems Annual Program Review Meeting", vol. II, "Advanced 3D Inverse Method for Designing Turbomachine Blades", T. Dang, p. 582, Oct. 1995.

"Proceedings of the Advanced Turbine Systems Annual Program Review Meeting", "ATS and the Industries of the Future", Denise Swink, p. 1, Nov. 1996.

"Proceedings of the Advanced Turbine Systems Annual Program Review Meeting", "Gas Turbine Association Agenda", William H. Day, pp. 3–16, Nov. 1996.

"Proceedings of the Advanced Turbine Systems Annual Program Review Meeting", "Power Needs in the Chemical Industry", Keith Davidson, pp. 17–26, Nov. 1996.

"Proceedings of the Advanced Turbine Systems Annual Program Review Meeting", "Advanced Turbine Systems Program Overview", David Esbeck, pp. 27–34, Nov. 1996.

"Proceedings of the Advanced Turbine Systems Annual Program Review Meeting", "Westinghouse's Advanced Turbine Systems Program", Gerard McQuiggan, pp. 35–48, Nov. 1996.

"Proceedings of the Advanced Turbine Systems Annual Program Review Meeting", "Overview of GE's H Gas Turbine Combined Cycle", Cook et al., pp. 49–72, Nov. 1996.

"Proceedings of the Advanced Turbine Systems Annual Program Review Meeting", "Allison Advanced Simple Cycle Gas Turbine System", William D. Weisbrod, pp. 73–94, Nov. 1996.

"Proceedings of the Advanced Turbine Systems Annual Program Review Meeting", "The AGTSR Industry–University Consortium", Lawrence P. Golan, pp. 95–110, Nov. 1996.

"Proceedings of the Advanced Turbine Systems Annual Program Review Meeting", "$NO_x$ and CO Emissions Models for Gas–Fired Lean–Premixed Combustion Turbines", A. Mellor, pp. 111–122, Nov. 1996.

"Proceedings of the Advanced Turbine Systems Annual Program Review Meeting", "Methodologies for Active Mixing and Combustion Control", Uri Vandsburger, pp. 123–156, Nov. 1996.

"Proceedings of the Advanced Turbine Systems Annual Program Review Meeting", "Combustion Modeling in Advanced Gas Turbine Systems", Paul O. Hedman, pp. 157–180, Nov. 19967.

"Proceedings of the Advanced Turbine Systems Annual Program Review Meeting", "Manifold Methods for Methane Combustion", Stephen B. Pope, pp. 181–188, Nov. 1996.

"Proceedings of the Advanced Turbine Systems Annual Program Review Meeting", "The Role of Reactant Unmixedness, Strain Rate, and Length Scale on Premixed Combustor Performance", Scott Samuelsen, pp. 182–210, Nov. 1996.

"Proceedings of the Advanced Turbine Systems Annual Program Review Meeting", "Effeect of Swirl and Momentum Distribution on Temperature Distribution in Premixed Flames", Ashwani K. Gupta, pp. 211–232, Nov. 1996.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", Active Control of Combustion Instabilities in Low $NO_x$ Turbines", Ben T. Zinn, pp. 253–264, Nov. 1996.

"Proceedings of the Advanced Turbine Systems Annual Program Review Meeting", "Life Prediction of Advanced Materials for Gas Turbine Application, " Sam Y. Zamrik, pp. 265–274, Nov. 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov. 1996.

"Proceedings of the Advanced Turbine Systems Annual Program Review Meeting", "Compatibility of Gas Turbine Materials with Steam Cooling", Vimal Desai, pp. 291–314, Nov. 1996.

"Proceedings of the Advanced Turbine Systems Annual Program Review Meeting", "Bond Strength and Stress Measurements in Thermal Barrier Coatings", Maurice Gell, pp. 315–334, Nov. 1996.

"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov. 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov. 1996.

"Proceedings of the Advanced Turbine Systems Annual Program Review Meeting", "Improved Modeling Techniques for Turbomachinery Flow Fields", B. Lakshiminarayana, pp. 371–392, Nov. 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov. 1996.

"Proceedings of the Advanced Turbine Systems Annual Program Review Meeting", "Advanced Turbine Cooling, Heat Transfer, and Aerodynamic Studies", Je–Chin Han. pp. 407–426, Nov. 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460, Nov. 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov. 1996.

"Proceedings of the Advanced Turbine Systems Annual Program Review Meeting", "Steam as a Turbine Blade Coolant: External Side Heat Transfer", Abraham Engeda, pp. 471–482, Nov. 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov. 1996.

"Proceedings of the Advanced Turbine Systems Annual Program Review Meeting", "Closed–Loop Mist/Steam Cooling for Advanced Turbine Systems", Ting Wang, pp. 499–512, Nov. 1996.

"Proceedings of the Advanced Turbine Systems Annual Program Review Meeting", "Heat Pipe Turbine Vane Cooling", Langston et al., pp. 513–534, Nov. 1996.

"Proceedings of the Advanced Turbine Systems Annual Program Review Meeting", "EPRI's Combustion Turbine Program: Status and Future Directions", Arthur Cohn, pp. 535–552 Nov. 1996.

"Proceedings of the Advanced Turbine Systems Annual Program Review Meeting", "ATS Materials Support", Michael Karnitz, pp. 553–576, Nov. 1996.

"Proceedings of the Advanced Turbine Systems Annual Program Review Meeting", "Land Based Turbine Casting Initiative", Boyd A. Mueller, pp. 577–592, Nov. 1996.

"Proceedings of the Advanced Turbine Systems Annual Program Review Meeting", "Turbine Airfoil Manufacturing Technology", Charles S. Kortovich, pp. 593–622, Nov. 1996.

"Proceedings of the Advanced Turbine Systems Annual Program Review Meeting", "Hot Corrosion Testing of TBS's", Norman Bornstein, pp. 623–631, Nov. 1996.
"Proceedings of the Advanced Turbine Systems Annual Program Review Meeting", "Ceramic Stationary Gas Turbine", Mark van Roode, pp. 633–658, Nov. 1996.
"Proceedings of the Advanced Turbine Systems Annual Program Review Meeting", "Western European Status of Ceramics for Gas Turbines", Tibor Bornemisza, pp. 659–670, Nov. 1996.
"Proceedings of the Advanced Turbine Systems Annual Program Review Meeting", "Status of Ceramic Gas Turbines in Russia", Mark van Roode, p. 671, Nov. 1996.
"Status Report: The U.S. Department of Energy's Advanced Turbine systems Program", facsimile dated Nov. 7, 1996.
"Testing Program Results Validate GE's H Gas Turbine–High Efficiency, Low Cost of Electricity and Low Emissions", Roger Schonewald and Patrick Marolda, (no date available).
"Testing Program Results Validate GE's H Gas Turbine–High Efficiency, Low Cost of Electricity and Low Emissions", Slide Presentation–working draft, (no date available).
"The Next Step in H...For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Numbers: DOE/MC/31176—5628.
"Utility Advanced Turbine System (ATS) Technology Readiness Testing—Phase 3", Document #66674, Oct. 1, 1996–Sep. 30, 1997, Publication Date, Dec. 31, 1997, Report Numbers: DOE/MC/31176–10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Numbers: DOE/MC/31176–5340.
"Utility Advanced Turbine System (ATS) Technology Readiness Testing and Pre–Commercial Demonstration–Phase 3", Document #486132, Apr. 1–Jun. 30, 1976, Publication Date, Dec. 31, 1996, Report Numbers: DOE/MC/31176–5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Numbers: DOE/MC/31176–5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Numbers: DOE/MC/31176–8.

"Utility Advanced Turbine System (ATS) Technology Readiness Testing and Pre–Commercialization Demonstration", Jan. 1–Mar. 31, 1996, DOE/MC/31176—5338.

"Utility Advanced Turbine System (ATS) Technology Readiness Testing: Phase 3R", Document #756552, Apr. 1–Jun. 30, 1999, Publication Date, Sep. 1, 1999, Report Numbers: DE—FC21–95MC31176–23.

"Utility Advanced Turbine System (ATS) Technology Readiness Testing, ", Document #656823, Jan. 1–Mar. 31, 1998, Publication Date, Aug. 1, 1998, Report Numbers: DOE/MC/31176–17.

"Utility Advanced Turbine Systems (ATS) Technology Readiness Testing and Pre–Commercial Demonstration", Annual Technical Progress Report, Reporting Period: Jul. 1, 1995–Sep. 30, 1996.

"Utility Advanced Turbine Systems (ATS) Technology Readiness Testing", Phase 3R, Annual Technical Progress Report, Reporting Period: Oct. 1, 1997–Sep. 30, 1998.

"Utility Advanced Turbine Systems (ATS) Technology Readiness Testing", Document #750405, Oct. 1–Dec. 30, 1998, Publication Date: May, 1, 1999, Report Numbers: DE–FC21–95MC31176–20.

"Utility Advanced Turbine Systems (ATS) Technology Readiness Testing", Document #1348, Apr. 1–Jun. 29, 1998, Publication Date Oct. 29, 1998, Report Numbers DE–FC21–95MC31176—18.

"Utility Advanced Turbine Systems (ATS) Technology Readiness Testing–Phase 3", Annual Technical Progress Report, Reporting Period: Oct. 1, 1996–Sep. 30, 1997.

"Utility Advanced Turbine Systems (ATS) Technology Readiness Testing and Pre–Commercial Demonstration", Quarterly Report, Jan. 1–Mar. 31, 1997, Document #666275, Report Numbers: DOE/MC/31176–07.

"Proceedings of the 1997 Advanced Turbine Systems", Annual Program Review Meeting, Oct. 28–29, 1997.

* cited by examiner

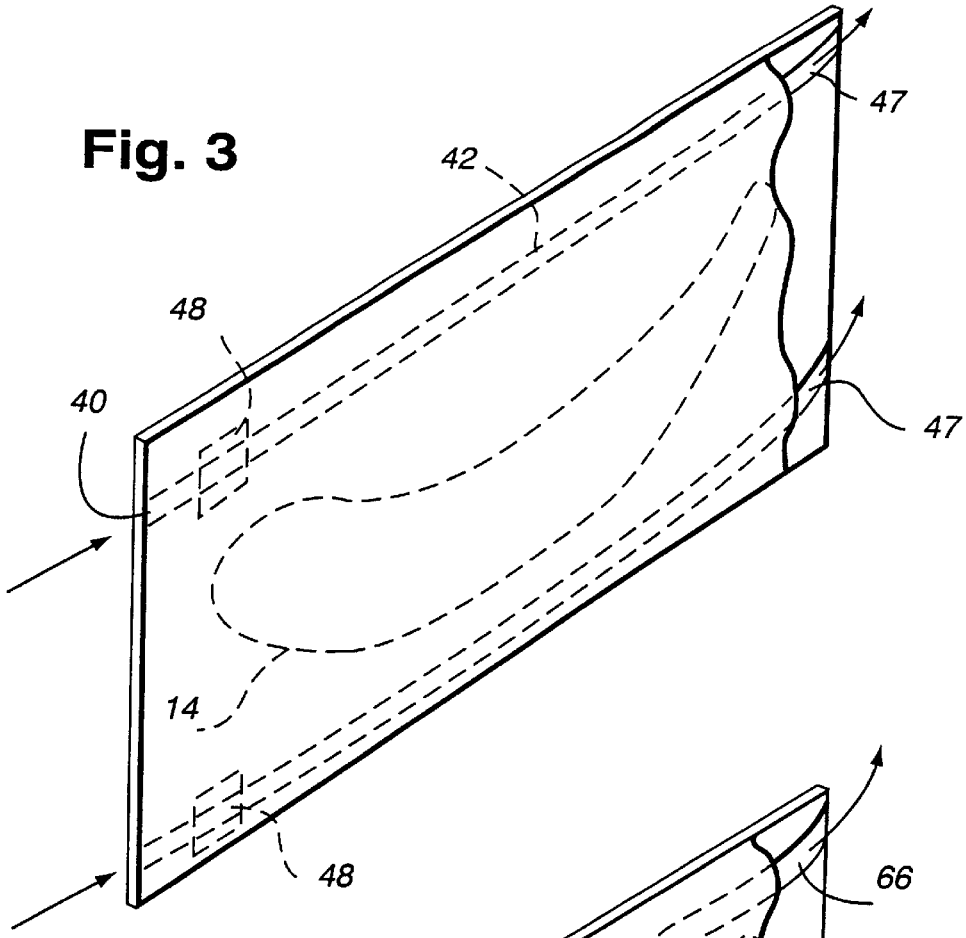
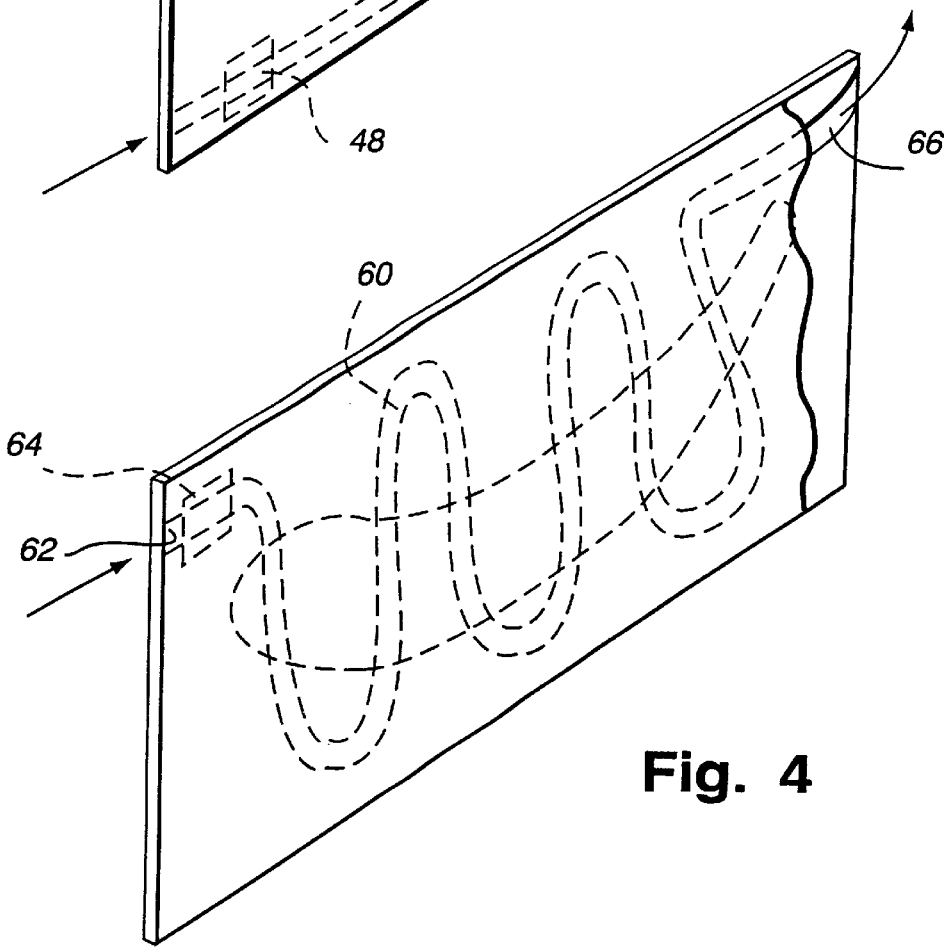
Fig. 4

APPARATUS AND METHODS FOR RELIEVING THERMALLY INDUCED STRESSES IN INNER AND OUTER BANDS OF THERMALLY COOLED TURBINE NOZZLE STAGES

This application is a continuation of application Ser. No. 09/311,640, filed May 14, 1999, now abandoned , the entire content of which is hereby incorporated by reference in this application.

The Government of the United States of America has rights in this invention pursuant to COOPERATIVE AGREEMENT NO. DE-FC21-95MC31176 awarded by the U.S. Department of Energy.

TECHNICAL FIELD

The present invention relates generally to gas turbines having closed cooling circuits in one or more nozzle stages and particularly relates to reducing thermally induced stresses in the inner and outer bands of the nozzle stages caused by temperature differentials between the hot gases of combustion flowing along the hot gas path and the cooling medium.

BACKGROUND OF THE INVENTION

In industrial or land-based gas turbines, one or more of the nozzle stages are cooled by passing a cooling medium from a plenum in each nozzle segment portion forming part of the outer band through one or more nozzle vanes to cool the nozzles and into a plenum in the corresponding inner band portion. The cooling medium then flows radially outwardly from the inner band portion, again through the one or more nozzle vanes for discharge. Typically, the cooling medium is steam. Each of the nozzle segments including the inner and outer band portions and one or more nozzle vanes are typically cast. Covers are applied to the inner and outer band portions on sides thereof remote from the hot gas path to define plenums for receiving the cooling medium. The covers are not cast with the nozzle segments. Rather, they are preferably later applied to the inner and outer band portions, for example, by welding or brazing. With this arrangement, the hot gas flowpath sides of the bands are exposed to relatively high temperatures, while the covers which are not directly exposed to the hot gases of combustion along the flowpath, remain considerably cooler. Additionally, the covers are exposed externally to compressor discharge air which, while having a temperature higher than the temperature of the steam cooling medium is still considerably less than the temperature of the inner and outer bands exposed to the hot gases of combustion. The temperature differential between the covers and the band portions, particularly along the weld lines between the covers and walls of the band portions exposed to the hot gas path cover results in high thermal stresses. As a consequence, there is a need to reduce the thermally induced stresses along the inner and outer bands of the nozzle stages caused principally by temperature differentials between the hot gases of combustion in the hot gas path, the cooling medium flowing through the inner and outer bands and the compressor discharge air.

BRIEF SUMMARY OF THE INVENTION

In accordance with a preferred embodiment of the present invention, the temperature difference between the flowpath exposed surfaces of the inner and outer bands and the covers exposed both to the cooling medium and the compressor discharge air is reduced by flowing a thermal medium along the covers at a temperature intermediate the temperature of the hot gases of combustion and the cooling medium through the cover and particularly adjacent the joints between the covers and the nozzle bands. The thermal medium flowing along the covers is at a significantly higher temperature than the temperatures of the cooling medium and the compressor discharge air in order to heat the cover so that the cover temperature approaches the bulk temperature of the flowpath exposed surfaces of the nozzle bands. To provide such thermal medium, a portion of the combustion path gases are directed through entry ports at the leading edges of the cover. Those gases follow passages through the cover and distribute heat substantially evenly to the cover for exit at the trailing edges of the covers into the hot gas path. Because of their very high temperature, flowpath gases alone can cause damage to the cover by way of oxidation, elevation of the bulk temperature of the covers in excess of that of the flowpath surfaces, and a reverse temperature gradient, resulting in similar high thermal stresses. To optimize the temperature of the thermal medium flowing through the heating passages in the covers, hot gases of combustion are combined with high pressure compressor discharge air for flow through the one or more passages in the cover. By providing one or more metering apertures in communication with compressor discharge air and with the passage(s) through the covers, hot flowpath gases entering the passage(s) are combined with compressor discharge air. This results in a thermal medium having a temperature sufficiently high to heat the cover adequately to reduce thermal stresses while avoiding the aforementioned and other problems.

Also, and advantageously, the mixture of hot combustion gases and compressor discharge air is (i) lower in pressure than both the compressor discharge air and hot gases of combustion at the leading edge of the passages and (ii) higher than the pressure of the hot gases of combustion at the trailing edge of the cover. Thus, the cooling medium flows passively through the passages between the leading edges to the trailing edges of the nozzle segments. The result is a cover having a temperature very close to the bulk temperature of the hot gas flowpath surfaces, thus reducing the thermal stresses induced by the thermal mismatch and affording higher component life and more reliable joints.

In a preferred embodiment according to the present invention, there is provided apparatus for controlling a temperature mismatch in at least one of the inner and outer bands of turbine nozzles having cooling circuits for flowing a cooling medium, comprising a nozzle segment having at least one nozzle vane and inner and outer nozzle band portions adjacent opposite ends of the nozzle vane and in part defining a path for flowing hot gases of combustion, one of the band portions forming a wall exposed to the hot gas path of the turbine and having a cover on a side of the wall remote from the hot gas path, the cover and the wall defining a plenum therebetween for receiving the cooling medium forming part of the cooling circuit, the segment including at least one passage through the cover for flowing a thermal medium at a temperature intermediate the temperature of the cooling medium and the hot gases of combustion to reduce the temperature differential between the cover and the wall and thereby reduce thermal-induced stresses in the one band portion.

In a further preferred embodiment according to the present invention, there is provided apparatus for controlling a temperature mismatch in at least one of inner and outer bands having a turbine nozzle vane therebetween and a cooling circuit for flowing a cooling medium through the nozzle vane, comprising a nozzle segment having at least one nozzle vane and inner and outer nozzle band portions adjacent opposite ends of the nozzle vane and in part defining a path for flowing hot gases of combustion, one of the band portions forming a wall exposed to a hot gas path of the turbine and having a cover on a side of the wall remote from the hot gas path, the cover and the wall, defining a plenum therebetween for receiving the cooling medium forming part of a nozzle cooling circuit, the cover and the wall of the band forming joints therebetween and along opposite sides thereof, the segment including passages through the cover from adjacent a leading edge to a trailing edge thereof and adjacent the joints for flowing the medium at a temperature intermediate the temperature of the cooling medium and the hot gases of combustion to reduce the temperature differential between the cover and the wall in the region of the joints to reduce thermal induced stresses in the one portion.

In a still further preferred embodiment according to the present invention, there is provided a method of reducing a temperature differential between a wall of an inner or an outer band of a turbine nozzle segment having a vane between the walls and a cover on a side of the wall remote from a flowpath for hot gases of combustion past the nozzle wherein the wall and cover define a plenum therebetween for receiving a cooling medium for flow through the nozzle vane, comprising the steps of flowing a thermal medium through at least one passage in the cover at a temperature intermediate respective temperatures of the hot gases of combustion and the cooling medium to elevate the temperature of the cover.

BRIEF DESCRIPTION OF THE DRAWINGS

FIGS. 3 and 4 are perspective schematic illustrations of covers for the inner or outer band segments.

DETAILED DESCRIPTION OF THE INVENTION

Figure 1:
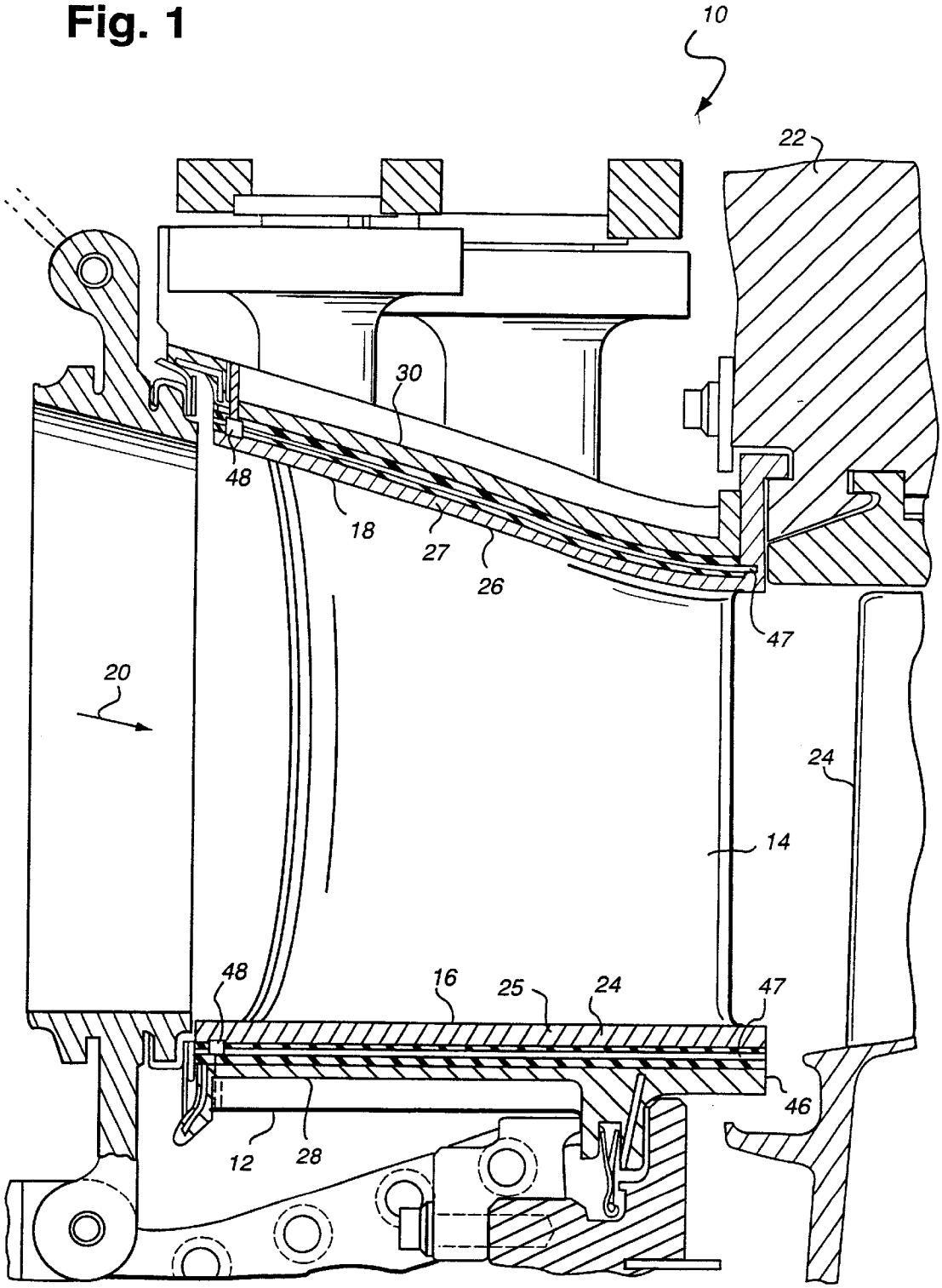
FIG. 1 is a fragmentary cross-sectional view illustrating a nozzle stage for a gas turbine incorporating the present invention.

Referring now to the drawings, particularly to FIG. 1, there is illustrated a nozzle stage, generally designated 10, comprised of a plurality of nozzle segments arranged circumferentially about the axis of the turbine. Each of the nozzle segments 12 includes one or more nozzle vanes 14 disposed between inner and outer band portions 16 and 18, respectively. It will be appreciated that the inner and outer band portions 16 and 18 and nozzle vanes 14 define a flowpath for hot gases of combustion flowing in the direction of the arrow 20. The nozzle segments are circumferentially arrayed about the turbine axis and secured to a fixed shell 22. Additionally illustrated in FIG. 1 is one of a plurality of circumferentially spaced buckets 24 forming part of the rotor of the turbine, it being appreciated that the hot gases of combustion flow through the buckets and rotate the rotor.

The inner and outer band portions 24 and 26, respectively, are comprised of inner and outer walls 25 and 27, respectively, exposed to the hot gases of combustion in flowpath 20 and inner and outer covers 28 and 30. The covers define with the walls plenums P for receiving a cooling medium, one plenum P being illustrated in FIG. 2 by the dashed lines. Particularly, the cooling medium is supplied to the outer wall plenum for impingement cooling of the radial outer band portion and for flow through the vane 14 into a plenum in the inner band portion. The cooling medium flows into the latter plenum for impingement cooling of the inner band wall and for discharge through radially outwardly extending passages through the vane 14 for return. It will be appreciated that the nozzle segment may be cast, for example, from a nickel alloy material. The covers 28 and 30 are secured to the walls of the cast nozzle segments to define the plenums, preferably by welded or brazed joints 32, illustrated in FIG. 5. Referring back to FIG. 1, the walls of the inner and outer band portions are, of course, exposed to the high temperature of the hot gases of combustion flowing along the flowpath 20, while the covers 28 and 30 are exposed to compressor discharge air on sides thereof remote from the walls. The compressor discharge air is, of course, at a lower temperature than the hot gases of combustion. Additionally, the cooling medium supplied to the nozzle via the plenums is at a temperature intermediate the temperature of the compressor discharge air and the hot gases flowing along flowpath 20. As noted previously, this causes a thermal mismatch between the cover and the inner and outer band portions, causing thermal stresses in the inner and outer band segments. The present invention minimizes or eliminates those thermal stresses by elevating the temperature of the cover to a temperature closer to the temperature of the inner and outer walls and intermediate the bulk temperature of the walls and the temperature of the cooling medium.

Figure 2:
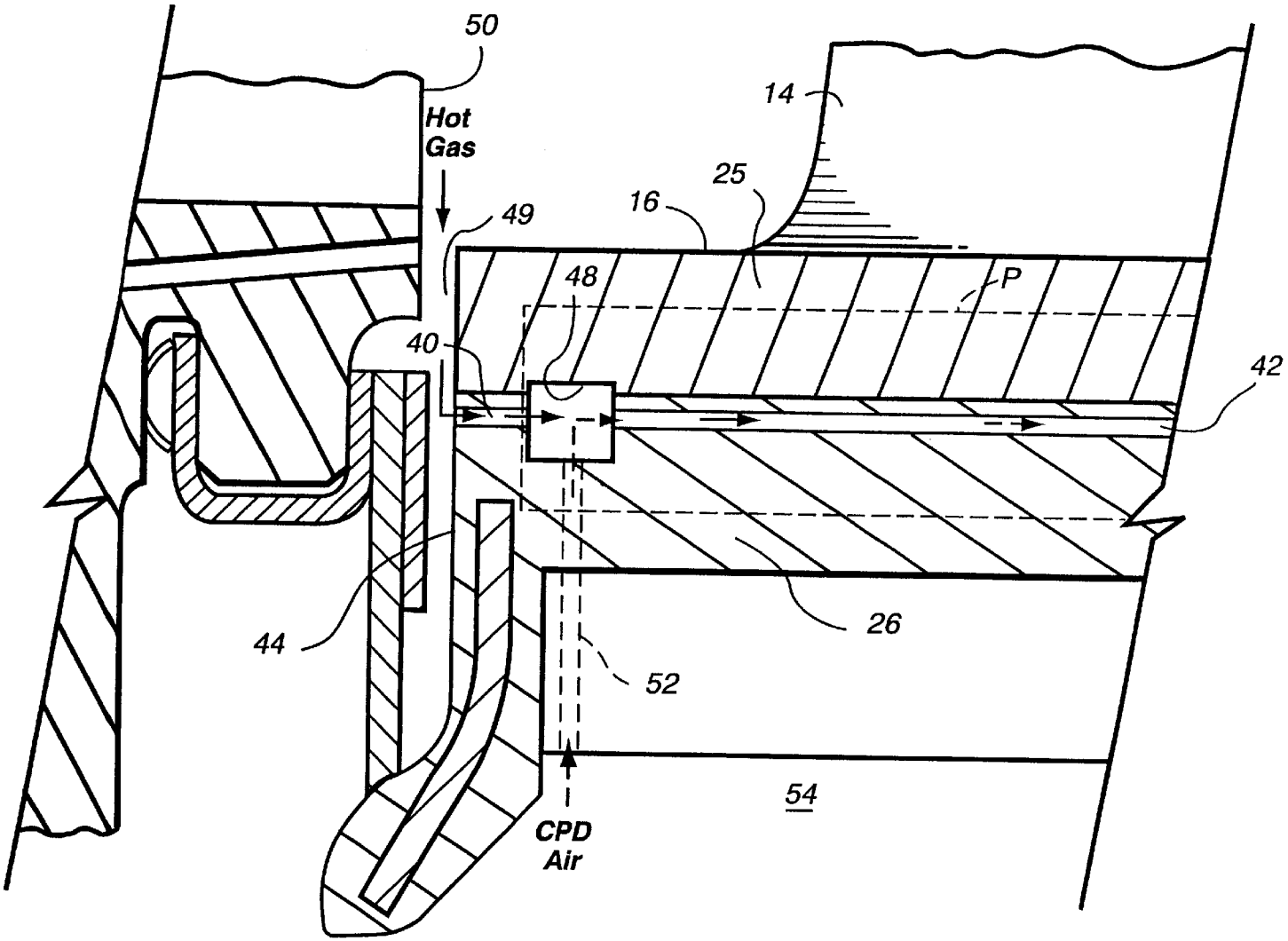
FIG. 2 is an enlarged fragmentary cross-sectional view illustrating a leading edge of the inner band portion of a nozzle segment.

To accomplish the foregoing, and referring to FIGS. 1 and 2, each cover has at least one passage and preferably a pair of passages 42 extending from its leading edge to its trailing edge for flowing a thermal, i.e., a heating medium to heat the cover and raise its temperature to approximate the bulk temperature of the wall. Referring to FIG. 2 and the inner band portion 16, the cover 26 includes at least one entry port 40 to each passage 42 which extends between the leading and trailing edges 44 and 46, respectively, of the cover to an exit port 47. A mixing chamber 48 is disposed in each passage 42 adjacent the leading edge 44. As best illustrated in FIG. 2, a slot 49 is formed between the leading edge of the nozzle segment and the adjoining structure 50 to permit passage of hot gases flowing along the hot gas path to enter the entry port 40 of the passage 42. Additionally, a passage 52 extends through the cover and lies in communication at respective opposite ends with the mixing chamber 48 and an area 54 containing compressor discharge air. Consequently, both hot gases of combustion and compressor discharge air are supplied to the mixing chamber 48 and mixed to provide a thermal medium having a temperature sufficient to raise the temperature of the cover to approximate the bulk temperature of the wall.

Figure 5:
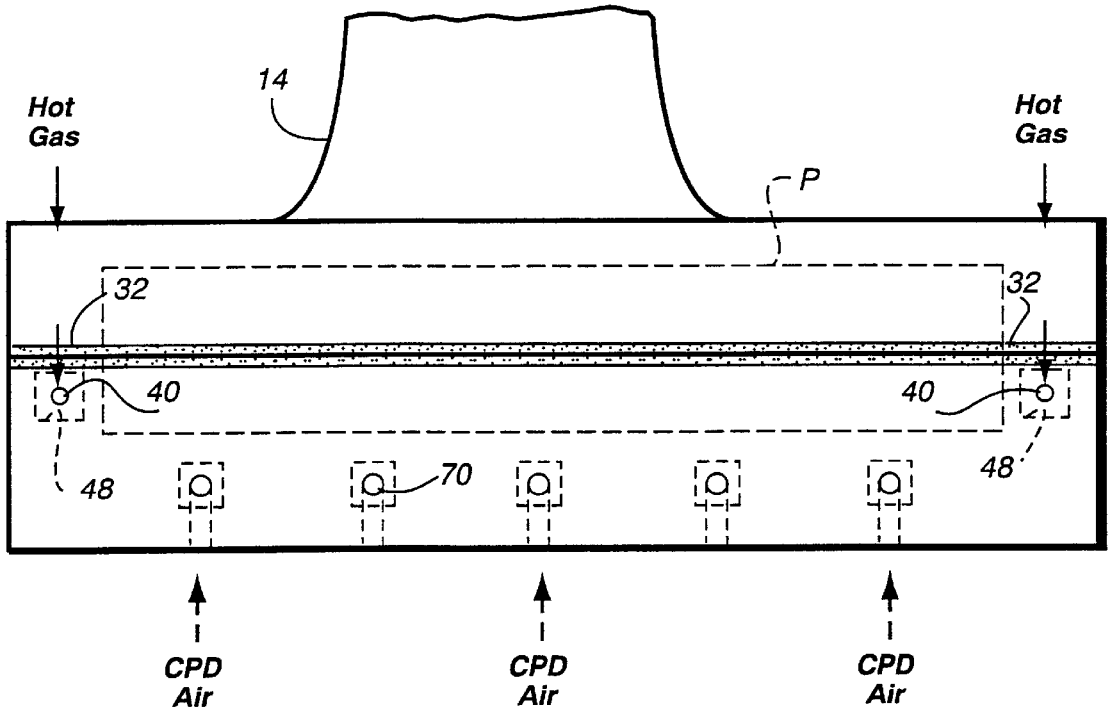
FIG. 5 is a fragmentary cross-sectional view of an inner band segment portion illustrating the thermal medium passages.

As best illustrated in FIGS. 3 and 5, an entry port 40 and passage 42 are located directly adjacent each joint between the cover and the wall along opposite sides of the cover. Additional passages 42, entry ports 40, mixing chambers 48 and exit ports 47 may also be provided through the covers from their leading edges to their trailing edges between the opposite sides of the covers. These additional passages therefore similarly heat the cover between opposite sides thereof, with the mixture of hot combustion gases and compressor discharge air. Referring to FIGS. 3 and 4, there is schematically illustrated a pair of covers which are useful with either the inner or outer band portions. In FIG. 3, for example, the inner cover 28 includes the passages 42 adjacent opposite side edges, the outline of the vane 14 being superimposed by the dashed lines on the illustrated cover. It will be seen that the exit port 47 of each passage 42 is angled at substantially the same angle as the hot gases of combustion flow from the trailing edge of the vane. It will be appreciated that the passages 42 illustrated in FIG. 3 lie along opposite sides of the cover directly adjacent the joints between the covers and the band portion 16.

In FIG. 4, the entirety of the cover is heated by the mixed hot gases of combustion and compressor discharge air. In this form, a serpentine passage 60 is provided through the cover. As in the prior embodiment, the entry port 62 directs hot gases of combustion into the mixing chamber 64. The combined hot gases and compressor discharge air then flow along passage 60 and into the hot gas stream via exit port 66. The exit port 66 is angled at substantially the same angle as the angle of the trailing edge of the vane so that the exiting thermal medium flows in substantially the same direction as the hot gases of combustion leaving the trailing edge of the vane.

It will be appreciated that the radial outer band portion is similarly configured as the inner band portion just described. That is, the outer band portion similarly includes entry ports adjacent opposite sides of the outer band portion in communication with mixing chambers adjacent the leading edge for mixing compressor discharge air and hot gases of combustion for flow through passages along the opposite edges of the cover and into the hot gas path adjacent the trailing edge of the outer cover.

From the foregoing, it will be appreciated that the temperature of the covers is heated by the mixture of the hot gases of combustion and compressor discharge air to a temperature which heats the covers to approximate the bulk temperature of the wall of the inner or outer band portions. Consequently, the temperature differential between the covers and the inner and outer wall band portions is substantially reduced sufficiently to minimize or eliminate thermal stresses. It will also be appreciated that a substantial number of passages may be disposed through each of the covers, substantially paralleling the pair of passages along opposite sides of the covers. For example, as illustrated in FIG. 5, the entry apertures for flowing hot gases of combustion into a plurality of mixing chambers within the cover and mixing the hot gases of combustion with compressor discharge air via passages 70 is illustrated. Thus, the entirety of the cover can be heated. Also, the pressure of the hot gases of combustion and compressor discharge air at the leading edge is greater than the pressure of the flowpath at the trailing edge. In this manner, the flow of the mixed gases does not require pumping and the gases flow passively to heat the covers.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for controlling a temperature mismatch in at least one of the inner and outer bands of a turbine including nozzles having cooling circuits for flowing a cooling medium, comprising:

a nozzle segment having at least one nozzle vane and inner and outer nozzle band portions adjacent opposite ends of said nozzle vane and in part defining a path for flowing hot gases of combustion;

one of said band portions forming a wall exposed to said hot gas path of said turbine and having a cover on a side of said wall remote from said hot gas path, said cover and said wall defining a plenum therebetween for receiving the cooling medium forming part of a cooling circuit;

said segment including at least one passage separate from and not in communication with said plenum and extending alone and through said cover along a length of said segment from adjacent a leading edge to a trailing edge thereof for flowing a thermal medium at a temperature intermediate the temperature of the cooling medium receivable in said plenum and the hot gases of combustion to reduce the temperature differential between said cover and said wall and thereby reduce thermal-induced stresses in said one band portion.

2. Apparatus according to claim 1 wherein said one passage lies in communication with the hot gases of combustion flowing along said flowpath.

3. Apparatus according to claim 1 wherein said one passage lies in communication with compressor discharge air on a side of said cover opposite said wall.

4. Apparatus according to claim 1 wherein said one passage lies in communication with the hot gases of combustion and compressor discharge air on a side of said cover opposite said wall.

5. Apparatus according to claim 1 wherein said one passage includes a mixing chamber adjacent a leading edge portion of the one nozzle band portion for mixing hot gases of combustion and compressor discharge air and flowing the mixed hot gases in combustion and compressor discharge air along said one passage.

6. Apparatus according to claim 1 wherein said cover and said wall of said one band portion form joints therebetween along opposite sides of said segment, said one passage extending adjacent one said joint along one side of said segment and a second passage extending adjacent a second joint along said opposite side of said segment for flowing said thermal medium thereby to reduce the temperature differential between said cover and said wall along said joints.

7. Apparatus for controlling a temperature mismatch in at least one of inner and outer bands having a turbine nozzle vane therebetween and a cooling circuit for flowing a cooling medium through the nozzle vane, comprising:

a nozzle segment having at least one nozzle vane and inner and outer nozzle band portions adjacent opposite ends of said nozzle vane and in part defining a path for flowing hot gases of combustion;

one of said band portions forming a wall exposed to a hot gas path of the turbine and having a cover on a side of said wall remote from the hot gas path, said cover and said wall, defining a plenum therebetween for receiving the cooling medium forming part of a nozzle cooling circuit, said cover and said wall of said band forming joints therebetween and along opposite sides thereof;

said segment including passages separate from and not in communication with said plenum and extending along and through said cover along a length thereof from adjacent a leading edge to a trailing edge thereof adjacent said joints for flowing the medium at a temperature intermediate the temperature of the cooling medium receivable in said plenum and the hot gases of combustion to reduce the temperature differential between said cover and said wall in the region of the joints to reduce thermal induced stresses in said one portion.

8. Apparatus according to claim 7 wherein said passages lie in communication with the hot gases of combustion flowing along said path and compressor discharge air on one side of said cover opposite said wall.

9. Apparatus according to claim 7 wherein each said passage includes a mixing chamber adjacent a leading edge portion of the one nozzle band portion for mixing hot gases of combustion and compressor discharge air and flowing the mixed hot gases of combustion and compressor discharge air along said passages.

10. A method of reducing a temperature differential between a wall of an inner or an outer band of a turbine nozzle segment having a vane between said walls and a cover on a side of the wall remote from a flowpath for hot gases of combustion past said nozzle wherein the wall and cover define a plenum therebetween for receiving a cooling medium for flow through the nozzle vane, comprising the steps of:

flowing a thermal medium through at least one passage in said cover separate from and not in communication with said plenum at a temperature intermediate respective temperatures of said hot gases of combustion and said cooling medium to elevate the temperature of the cover.

11. A method according to claim 10 including flowing hot gases of combustion through said passage.

12. A method according to claim 10 including flowing compressor discharge air through said passage.

13. A method according to claim 10 including flowing hot gases of combustion and compressor discharge air through said passage.

14. A method according to claim 10 including mixing hot gases of combustion and compressor discharge air in a mixing chamber adjacent a leading edge of the wall to form the thermal medium and flowing the mixture from adjacent said leading edge along said passage to a trailing edge of said wall.

15. A method according to claim 14 including extending said passage in a serpentine manner between opposite sides of said segment and between leading and trailing edges thereof.

16. A method according to claim 14 including a joint between said cover and said wall along opposite sides of said segment, and forming a pair of passages adjacent said joint and flowing the thermal medium through said pair of passages adjacent said joints.

17. Apparatus for controlling a temperature mismatch in at least one of the inner and outer bands of turbine nozzles having cooling circuits for flowing a cooling medium, comprising:

a nozzle segment having at least one nozzle vane and inner and outer nozzle band portions adjacent opposite ends of said nozzle vane and in part defining a path for flowing hot gases of combustion;

one of said band portions forming a wall exposed to said hot gas path of said turbine and having a cover on a side of said wall remote from said hot gas path, said cover and said wall defining a plenum therebetween for receiving the cooling medium forming part of the cooling circuit;

said segment including at least one passage through said cover for flowing a thermal medium at a temperature intermediate the temperature of the cooling medium and the hot gases of combustion to reduce the temperature differential between said cover and said wall and thereby reduce thermal-induced stresses in said one band portion; and wherein said one passage has an exit opening angled to direct the thermal medium at substantially the same angle as the hot gases of combustion exit a trailing edge of said one nozzle vane.

18. Apparatus for controlling a temperature mismatch in at least one of the inner and outer bands of turbine nozzles having cooling circuits for flowing a cooling medium, comprising:

a nozzle segment having at least one nozzle vane and inner and outer nozzle band portions adjacent opposite ends of said nozzle vane and in part defining a path for flowing hot gases of combustion;

one of said band portions forming a wall exposed to said hot gas path of said turbine and having a cover on a side of said wall remote from said hot gas path, said cover and said wall defining a plenum therebetween for receiving the cooling medium forming part of the cooling circuit;

said segment including at least one passage through said cover for flowing a thermal medium at a temperature intermediate the temperature of the cooling medium and the hot gases of combustion to reduce the temperature differential between said cover and said wall and thereby reduce thermal-induced stresses in said one band portion; and wherein said one passage extends in a generally serpentine manner between opposite side edges of said one band portion from a leading edge to a trailing edge thereof.

19. A method of reducing a temperature differential between a wall of an inner or an outer band of a turbine nozzle segment having a vane between said walls and a cover on a side of the wall remote from a flowpath for hot gases of combustion past said nozzle wherein the wall and cover define a plenum therebetween for receiving a cooling medium for flow through the nozzle vane, comprising the steps of:

flowing a thermal medium through at least one passage in said cover at a temperature intermediate respective temperatures of said hot gases of combustion and said cooling medium to elevate the temperature of the cover;

mixing hot gases of combustion and compressor discharge air in a mixing chamber adjacent a leading edge of the wall to form the thermal medium and flowing the mixture from adjacent said leading edge along said passage to a trailing edge of said wall; and flowing the thermal medium exiting at the trailing edge of the wall at substantially the same angle as hot gases of combustion exit the trailing edge of the nozzle vane.

20. Apparatus for controlling a temperature mismatch in at least one of the inner and outer bands of turbine nozzles having cooling circuits for flowing a cooling medium, comprising:

a nozzle segment having at least one nozzle vane and inner and outer nozzle band portions adjacent opposite ends of said nozzle vane and in part defining a path for flowing hot gases of combustion;

one of said band portions forming a first wall exposed to said hot gas path of said turbine and having a second wall on a side of said first wall remote from said hot gas path, said walls defining a plenum therebetween for receiving the cooling medium forming part of the cooling circuit;

said segment including at least one passage through said second wall for flowing a thermal medium at a temperature intermediate the temperature of the cooling medium and the hot gases of combustion to reduce the temperature differential between said walls and thereby reduce thermal-induced stresses in said one band portion.

* * * * *